US009447993B2

(12) United States Patent
Higashiiue

(10) Patent No.: US 9,447,993 B2
(45) Date of Patent: Sep. 20, 2016

(54) REFRIGERATION CYCLE DEVICE AND AIR-CONDITIONING APPARATUS

(75) Inventor: Shinya Higashiiue, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 442 days.

(21) Appl. No.: 14/124,019

(22) PCT Filed: Jul. 1, 2011

(86) PCT No.: PCT/JP2011/065141

§ 371 (c)(1),
(2), (4) Date: Dec. 5, 2013

(87) PCT Pub. No.: WO2013/005270

PCT Pub. Date: Jan. 10, 2013

(65) Prior Publication Data

US 2014/0096557 A1 Apr. 10, 2014

(51) Int. Cl.

| | |
|---|---|
| ***F25B 13/00*** | (2006.01) |
| ***F25B 1/06*** | (2006.01) |
| ***F25B 41/00*** | (2006.01) |

(52) U.S. Cl.

CPC ..... *F25B 1/06* (2013.01); *F25B 13/00* (2013.01); *F25B 41/00* (2013.01); *F25B 2313/023* (2013.01); *F25B 2313/025* (2013.01); *F25B 2313/0272* (2013.01); *F25B 2313/02732* (2013.01); *F25B 2313/02741* (2013.01); *F25B 2341/0012* (2013.01); *F25B 2341/0013* (2013.01)

(58) Field of Classification Search

CPC ..... F25B 1/06; F25B 2341/0012; F25B 2341/0013

See application file for complete search history.

(56) References Cited

FOREIGN PATENT DOCUMENTS

| | | | | |
|---|---|---|---|---|
| JP | 55-26274 U | | 2/1980 | |
| JP | 2004-156812 A | | 6/2004 | |
| JP | 2004-309029 A | | 11/2004 | |
| JP | 2005-037114 A | | 2/2005 | |
| JP | 2007-024398 A | | 2/2007 | |
| JP | 4196873 B2 | * | 12/2008 | ..... F25B 13/00 |
| JP | 2009-109064 A | | 5/2009 | |
| JP | 2009-276051 A | | 11/2009 | |
| JP | 2010-133584 A | | 6/2010 | |
| JP | 4539571 B2 | | 7/2010 | |
| JP | 2010-236706 A | | 10/2010 | |
| JP | 2011-080729 A | | 4/2011 | |

OTHER PUBLICATIONS

Machine Translation of Detailed Description of JP-4196873.*

(Continued)

*Primary Examiner* — Orlando Aviles Bosques

(74) *Attorney, Agent, or Firm* — Posz Law Group, PLC

(57) ABSTRACT

A refrigeration cycle device selectively performs a heating operation and a cooling operation. The refrigeration cycle device includes: a compressor that suctions a refrigerant and compresses the refrigerant; a first heat exchanger, a second heat exchanger, a third heat exchanger, and a fourth heat exchanger each of which exchanges heat with the refrigerant; an ejector that includes a refrigerant inlet port, a refrigerant suction port, and a refrigerant outlet port; a controller that is connected between the first heat exchanger and the second heat exchanger and configured to control a flow rate of the refrigerant; and a switching device configured to perform switching of a flow path of the refrigerant in both the heating and cooling operations.

13 Claims, 10 Drawing Sheets

(56) References Cited

OTHER PUBLICATIONS

Office Action dated Feb. 27, 2015 issued in corresponding CN patent application No. 201180072028.0 (and English translation).

International Search Report of the International Searching Authority mailed Aug. 30, 2011 for the corresponding international application No. PCT/JP2011/065141 (and English translation).

Extended European Search Report mailed Mar. 13, 2015 in the corresponding European Patent application No. 11869123.7.

* cited by examiner

REFRIGERATION CYCLE DEVICE AND AIR-CONDITIONING APPARATUS

CROSS REFERENCE TO RELATED APPLICATIONS

This application is a U.S. national stage application of International Application No. PCT/JP2011/065141 filed on Jul. 1, 2011, the disclosure of which is incorporated by reference.

TECHNICAL FIELD

The present invention relates to a refrigeration cycle device and an air-conditioning apparatus. The present invention relates to, for example, a refrigeration cycle device that includes an ejector that achieves a highly-efficient operation of a heat pump.

BACKGROUND ART

In a refrigeration cycle device of the conventional art that includes an ejector, a high-pressure refrigerant that is liquefied by a condenser is caused to flow into a nozzle unit of the ejector, and pressure energy is converted into velocity energy. In a mixing portion, the velocity energy is converted back into pressure energy by momentum transfer between a refrigerant that is ejected from the nozzle at supersonic speed and a low-pressure refrigerant that is drawn from the other refrigerant inlet port of the ejector. As a result, a highly-efficient operation of a refrigeration cycle through a suction pressure of a compressor is achieved (see, for example, Patent Literatures 1 to 3).

Such a refrigeration cycle device of the conventional art further includes a check valve in order to cause a high-pressure refrigerant to always flow into a refrigerant inlet port of an ejector and performs a power recovery operation in both a cooling operation mode and a heating operation mode. As a result, energy saving in the refrigeration cycle is achieved (see, for example, Patent Literatures 4 to 7).

CITATION LIST

Patent Literature

Patent Literature 1: Japanese Unexamined Patent Application Publication No. 2007-198675

Patent Literature 2: Japanese Unexamined Patent Application Publication No. 2007-24398

Patent Literature 3: Japanese Unexamined Patent Application Publication No. 2004-156812

Patent Literature 4: Japanese Unexamined Patent Application Publication No. 2010-236706

Patent Literature 5: Japanese Unexamined Patent Application Publication No. 2010-133584

Patent Literature 6: Japanese Unexamined Patent Application Publication No. 2005-37114

Patent Literature 7: Japanese Unexamined Patent Application Publication No. 2004-309029

SUMMARY OF INVENTION

Technical Problem

In the above-described refrigeration cycle device of the conventional art, which includes the ejector, in the case of a cooling operation, a highly-efficient operation of the refrigeration cycle can be performed through power recovery performed by the ejector. However, in the case of a heating operation, a high-pressure refrigerant that has flowed out from a condenser flows in from an outlet port of the ejector, that is, a pressurizing portion of the ejector. Therefore, the highly-efficient operation of the refrigeration cycle through power recovery cannot be achieved.

In the above-described refrigeration cycle device of the conventional art that includes a check valve, lubricating oil that flows out from a compressor along with a refrigerant stays in a gas-liquid separator that is disposed at the outlet port of the ejector. Therefore, the amount of the lubricating oil in the compressor is reduced, and as a result, failure of the compressor occurs. In addition, in order to avoid such a failure, it is necessary to perform a regular oil-return operation. Therefore, the reliability of the refrigeration cycle decreases.

It is an object of the present invention to provide a refrigeration cycle device that is capable of operating with high efficiency in both a heating operation and a cooling operation and that is reliable.

Solution to Problem

A refrigeration cycle device according to an aspect of the present invention is a refrigeration cycle device that performs a heating operation and a cooling operation selectively, the refrigeration cycle device comprising: a compressor that suctions a refrigerant and compresses the refrigerant; a first heat exchanger, a second heat exchanger, a third heat exchanger, and a fourth heat exchanger each of which exchanges heat with the refrigerant; an ejector that includes a refrigerant inlet port, a refrigerant suction port, and a refrigerant outlet port, and that is configured to decompress the refrigerant that flows into the refrigerant inlet port, pressurize the refrigerant by mixing the refrigerant that has been decompressed, and the refrigerant that is suctioned by the refrigerant suction port together, and discharge the refrigerant that has been pressurized, from the refrigerant outlet port; a controller that is connected between the first heat exchanger and the second heat exchanger and configured to control a flow rate of the refrigerant; and a switching device configured to perform, in a heating operation, switching of a flow path of the refrigerant in such a manner that the refrigerant that is compressed by the compressor flows into the refrigerant inlet port of the ejector via the third heat exchanger and is suctioned by the refrigerant suction port of the ejector via the first heat exchanger, the controller, and the second heat exchanger in this order, and the refrigerant that is discharged from the refrigerant outlet port of the ejector is suctioned by the compressor via the fourth heat exchanger and the switching device being configured to perform, in a cooling operation, switching of a flow path of the refrigerant in such a manner that the refrigerant that is compressed by the compressor flows into the refrigerant inlet port of the ejector via the fourth heat exchanger and is suctioned by the refrigerant suction port of the ejector via the second heat exchanger, the controller, and the first heat exchanger in this order, and the refrigerant that is discharged from the refrigerant outlet port of the ejector is suctioned by the compressor via the third heat exchanger.

Advantageous Effects of Invention

According to an aspect of the present invention, a refrigeration cycle device that is capable of operating with high efficiency in both a heating operation and a cooling operation and that is reliable can be provided.

DESCRIPTION OF EMBODIMENTS

Embodiments of the present invention will be described below with reference to the drawings.

Embodiment 1.

Figure 1:
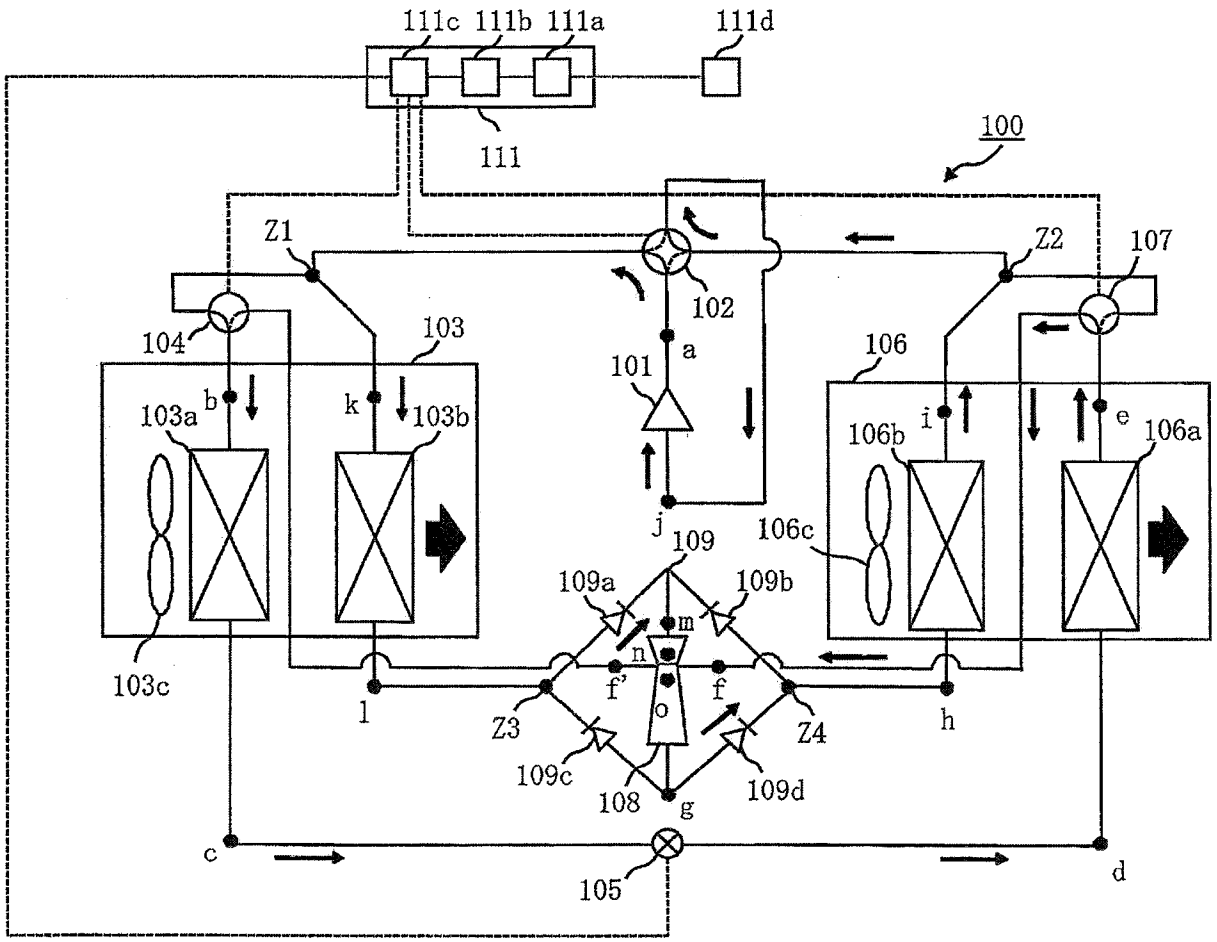
FIG. 1 is a schematic diagram illustrating the configuration of a refrigeration cycle device according to Embodiment 1 (in a heating operation).
Figure 2:
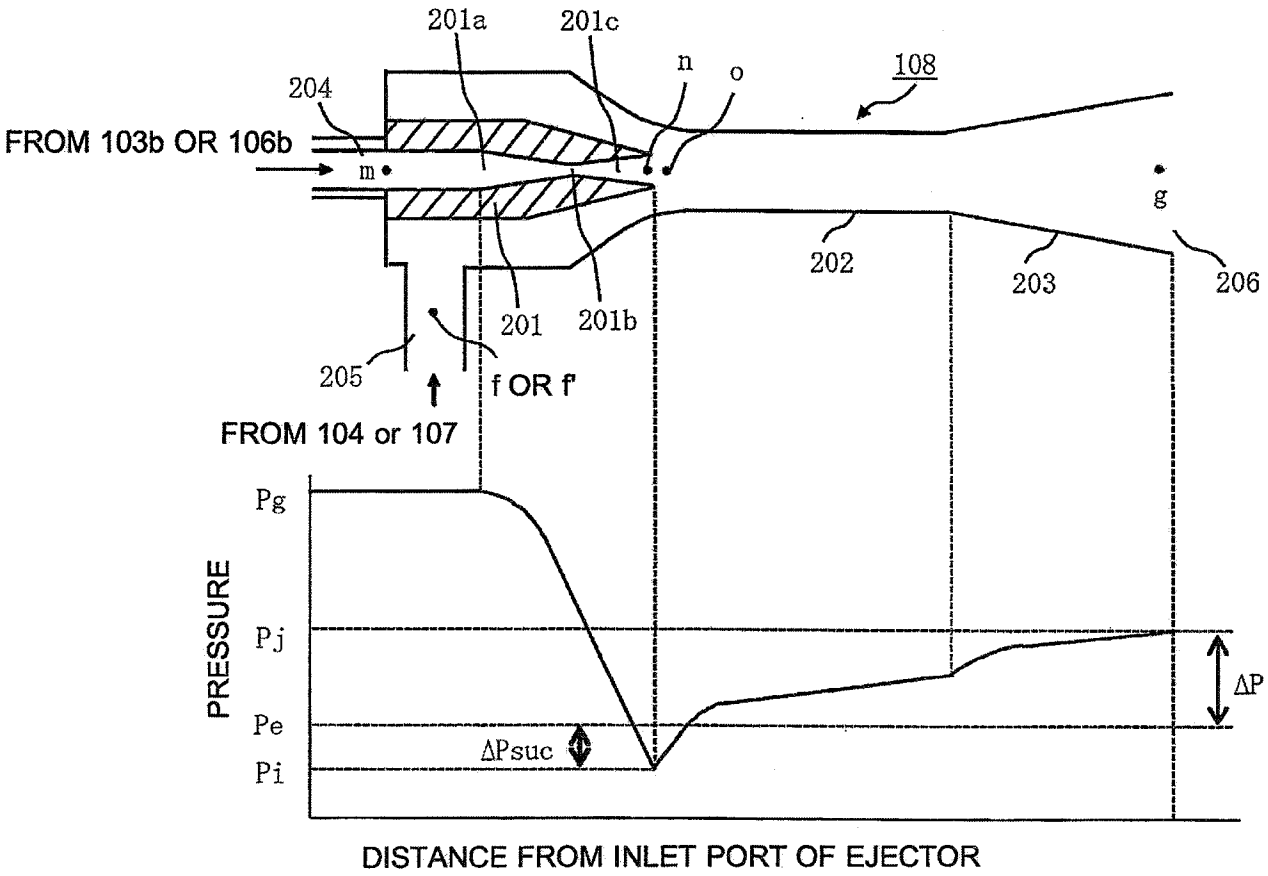
FIG. 2 is a schematic diagram illustrating the internal structure of an ejector that is provided in the refrigeration cycle device according to Embodiment 1.

FIG. 1 is a schematic diagram illustrating the configuration of a refrigeration cycle device 100 according to Embodiment 1 (in a heating operation). Thin arrows in FIG. 1 indicate directions in which a refrigerant flows. FIG. 2 is a schematic diagram illustrating the internal structure of an ejector 108 that is provided in the refrigeration cycle device 100.

The configuration of the refrigeration cycle device 100 will be described.

In FIG. 1, the refrigeration cycle device 100 includes a compressor 101, a four-way valve 102, an indoor heat exchanger 103, a flow rate control valve 105, the ejector 108, and an outdoor heat exchanger 106. The refrigeration cycle device 100 forms a closed loop by connecting element units by refrigerant pipes.

The indoor heat exchanger 103 includes a first indoor heat exchanger 103*a* and a second indoor heat exchanger 103*b*. In other words, the indoor heat exchanger 103 is divided into two portions. The outdoor heat exchanger 106 includes a first outdoor heat exchanger 106*a* and a second outdoor heat exchanger 106*b*. In other words, the outdoor heat exchanger 106 is divided into two portions. The first indoor heat exchanger 103*a*, the flow rate control valve 105, and the first outdoor heat exchanger 106*a* are connected by refrigerant pipes. A first switching valve 104 is connected between the first indoor heat exchanger 103*a* and the four-way valve 102. A second switching valve 107 is connected between the first outdoor heat exchanger 106*a* and the four-way valve 102. The first switching valve 104 and the second switching valve 107 are, for example, three-way valves, and one remaining connecting portion of each of the first switching valve 104 and the second switching valve 107 is connected to a refrigerant suction port 205 of the ejector 108, which will be described later, by a refrigerant pipe. The second indoor heat exchanger 103*b* and the second outdoor heat exchanger 106*b* are connected to a refrigerant inlet port 204 of the ejector 108 via a flow path switching device 109. A refrigerant outlet port 206 of the ejector 108 is connected to the second indoor heat exchanger 103*b* and the second outdoor heat exchanger 106*b* via the flow path switching device 109.

The flow path switching device 109 is formed of a bridge circuit that is formed of check valves 109*a*, 109*b*, 109*c*, and 109*d*, and the flow path switching device 109 is connected to a nozzle unit 201 of the ejector 108 in such a manner that a high-pressure refrigerant always flows into the nozzle unit 201.

The indoor heat exchanger 103 includes an air-sending fan 103*c* that facilitates heat exchange between indoor air and a refrigerant. A position at which the air-sending fan 103*c* is disposed is adjusted in such a manner that air that is sent out from the air-sending fan 103*c* flows from the first indoor heat exchanger 103*a* to the second indoor heat exchanger 103*b*.

The outdoor heat exchanger 106 includes an air-sending fan 106*c* that facilitates heat exchange between the outside air and a refrigerant. A position at which the air-sending fan 106*c* is disposed is adjusted in such a manner that air that is sent out from the air-sending fan 106c flows from the first outdoor heat exchanger 106*a* to the second outdoor heat exchanger 106*b*.

The refrigeration cycle device 100 includes a control unit 111 that is equipped with a microcomputer. The control unit 111 includes a receiving unit 111*a*, an operation unit 111*b*, and a sending unit 111*c*. The receiving unit 111*a* is connected, by electric signal lines (e.g., wireless connection), to a command device 111*d* (e.g., a remote controller) that instructs the refrigeration cycle device 100 to operate. The sending unit 111*c* is connected, by electric signal lines (e.g., wired connection), to the four-way valve 102, the first switching valve 104, the second switching valve 107, and the flow rate control valve 105. A control signal that is transmitted from the command device 111*d* is received by the receiving unit 111*a*, and after that, the control signal is processed by the operation unit 111*b*. Then, the control signal is transmitted from the sending unit 111*c* to the four-way valve 102, the first switching valve 104, the second switching valve 107, and the flow rate control valve 105.

In FIG. 2, the ejector 108 includes the nozzle unit 201, a mixing portion 202, and a diffuser portion 203. The nozzle unit 201 includes an expansion portion 201*a*, a throat portion 201*b*, and a diverging portion 201*c*. In the ejector 108, a high-pressure refrigerant (a motive refrigerant) that has flowed out from a condenser (the first indoor heat exchanger 103*a* in a heating operation and the first outdoor heat exchanger 106*a* in a cooling operation) is, via the refrigerant inlet port 204, decompressed and expanded in the expansion portion 201*a* in such a manner as to flow at sonic speed through the throat portion 201*b*, and in addition, decompressed and accelerated in the diverging portion 201*c* in such a manner as to flow at supersonic speed. As a result, a two-phase gas-liquid refrigerant flows out from the nozzle unit 201 at an ultrahigh speed. On the other hand, a refrigerant (a suction refrigerant) from a switching valve (the second switching valve 107 in a heating operation and the first switching valve 104 in a cooling operation) is drawn into the mixing portion 202 by the refrigerant, which flows out from the nozzle unit 201 at an ultrahigh speed, via the refrigerant suction port 205. The motive refrigerant that flows at an ultrahigh speed and the suction refrigerant that flows at a low speed start to mix with each other in an outlet port of the nozzle unit 201, that is, an inlet port of the mixing portion 202, and a pressure is recovered (increased) by momentum transfer between the motive refrigerant and the suction refrigerant. Similarly, in the diffuser portion 203, dynamic pressure is converted into static pressure by a reduction in speed due to expansion of a flow path, and the pressure is increased. As a result, a refrigerant flows out from the diffuser portion 203 via the refrigerant outlet port 206.

Operation of the refrigeration cycle device 100 in a heating operation will be described.

Figure 3:
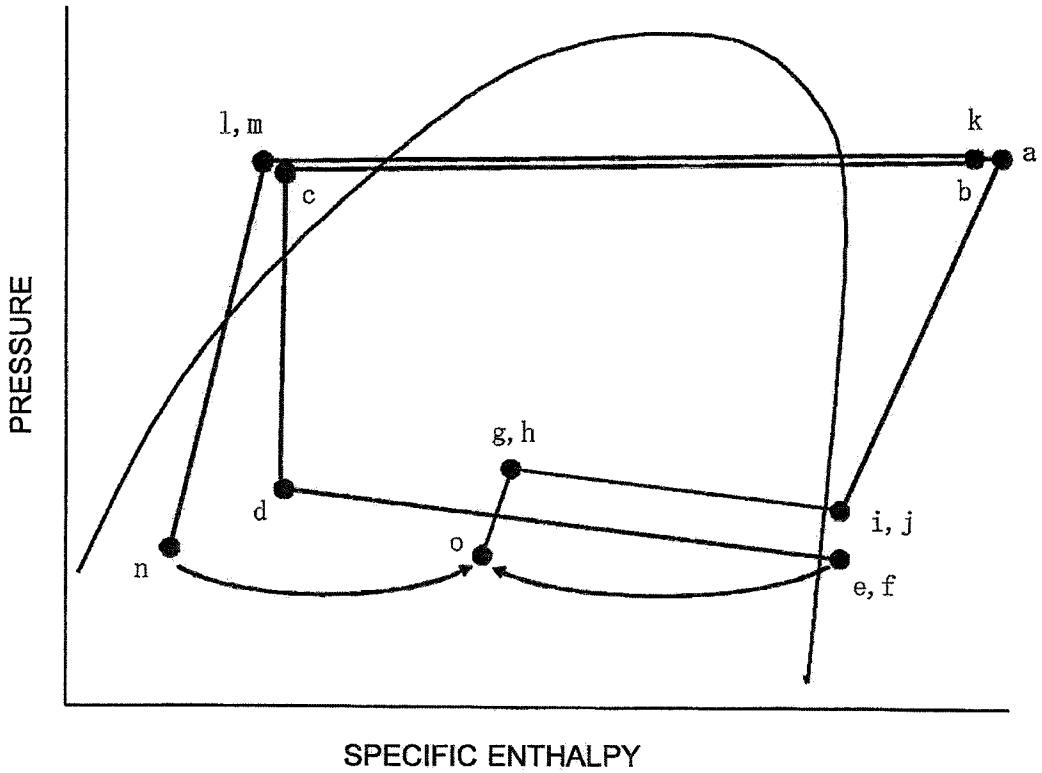
FIG. 3 is a refrigeration cycle diagram (a Mollier diagram) illustrating states of a refrigerant in the refrigeration cycle device according to Embodiment 1 in a heating operation.

FIG. 3 is a refrigeration cycle diagram (a Mollier diagram) illustrating states of a refrigerant in the refrigeration cycle device 100 in a heating operation. In FIG. 3, the horizontal axis represents the specific enthalpy of the refrigerant, and the vertical axis represents pressure. Points a to o in the diagram of FIG. 3 represent states of a refrigerant in each of the pipes illustrated in FIG. 1.

In FIG. 1 and FIG. 3, a high temperature, high pressure gas refrigerant that has been sent out from the compressor 101 and is in a state a passes through the four-way valve 102, and splits so as to flow into the first indoor heat exchanger 103*a* and the second indoor heat exchanger 103*b* at a branch point Z1. The refrigerant that splits and flows in the first indoor heat exchanger 103*a* passes through the first switching valve 104 and is condensed in the first indoor heat exchanger 103*a* through heat exchange between the refrigerant and the indoor air. Then, the refrigerant changes from a state b to a state c. A liquid or two-phase gas-liquid refrigerant in the state c enters a state d by being decompressed in the flow rate control valve 105, and after that, flows into the first outdoor heat exchanger 106*a*. In the first outdoor heat exchanger 106*a*, the refrigerant is evaporated through heat exchange between the refrigerant and the outside air and changes from the state d to a state e. The refrigerant that is in the state e and in the gas phase passes through the second switching valve 107 and flows into the refrigerant suction port 205 of the ejector 108.

On the other hand, the refrigerant that flows in the second indoor heat exchanger 103*b* from the branch point Z1 is condensed by the air, which has undergone heat exchange in the first indoor heat exchanger 103*a*, and changes from a state k to a state l. The refrigerant in the state l flows into the refrigerant inlet port 204 of the ejector 108 from a branch point Z3 by passing through the check valve 109*a*. The refrigerant in a state m that flows in the refrigerant inlet port 204 changes to a state n by being decompressed in the nozzle unit 201, and after that, is mixed with a refrigerant in a state f that has flowed from the refrigerant suction port 205 in such a manner as to enter a state o. The pressure of the refrigerant in the state o increases in the mixing portion 202 and the diffuser portion 203, and after that, the refrigerant enters a state g and flows out from the refrigerant outlet port 206. The refrigerant in the state g flows into the second outdoor heat exchanger 106*b* by passing through the check valve 109*d*. The refrigerant in a state h that flows in the second outdoor heat exchanger 106*b* is evaporated through heat exchange between the refrigerant and the outside air and enters a state I and flows into the four-way valve 102 and a suction port of the compressor 101.

Figure 4:
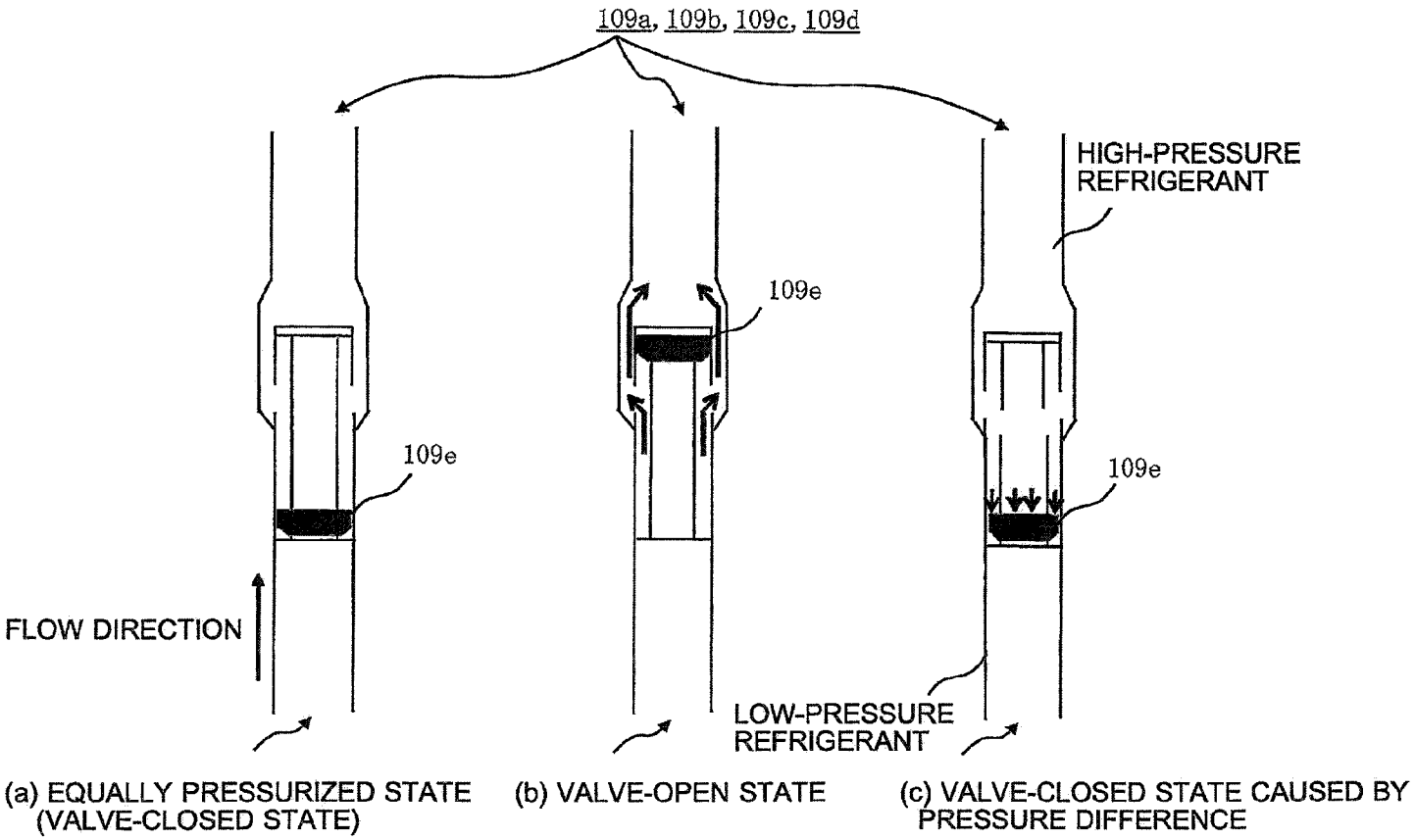
FIG. 4 is a schematic diagram of check valves that form a flow rate control device that is provided in the refrigeration cycle device according to Embodiment 1.

FIG. 4 is a schematic diagram of the check valves 109*a*, 109*b*, 109*c*, and 109*d* that form the flow path switching device 109.

The check valves 109*a*, 109*b*, 109*c*, and 109*d* are disposed in such a manner that a refrigerant flows in an upward direction from a bottom side. (a) In the case where the pressure in a refrigerant circuit is equalized, the valve 109*e* is moved downward by its own weight. Therefore, the check valves 109*a*, 109*b*, 109*c*, and 109*d* are in a closed state. (b) In the case where a refrigerant flows in an upward direction from the bottom side, the valve 109*e* is raised upward. As a result, a flow path is opened, and the refrigerant flows. In other words, the check valves 109*a*, 109*b*, 109*c*, and 109*d* are in an open state. Although not illustrated, in the case where a refrigerant flows in a downward direction from a top side, the valve 109*e* moves downward, and thus the flow path is blocked. Therefore, the check valves 109*a*, 109*b*, 109*c*, and 109*d* are in the closed state. (c) In the case where there is a pressure difference between inlet and outlet ports of each of the check valves 109*a*, 109*b*, 109*c*, and 109*d* (for example, in the case where a pressure difference such as that between a high-pressure refrigerant and a low-pressure refrigerant in the refrigeration cycle device 100 acts on the inlet and outlet ports of each of the check valves 109*a*, 109*b*, 109*c*, and 109*d*), the valve 109*e* is pressed down by the high-pressure refrigerant. Therefore, the check valves 109*a*, 109*b*, 109*c*, and 109*d* are in the closed state.

In a heating operation, as a result of the operation of the valve 109*e* such as that described above, the check valves 109*a* and 109*d* are in the open state, and the check valves 109*b* and 109*c* are in the closed state. Therefore, a refrigerant flows into the ejector 108 via the check valve 109*a* and flows into the second outdoor heat exchanger 106*b* via the check valve 109*d*.

Operation of the refrigeration cycle device 100 in a cooling operation will be described.

Figure 5:
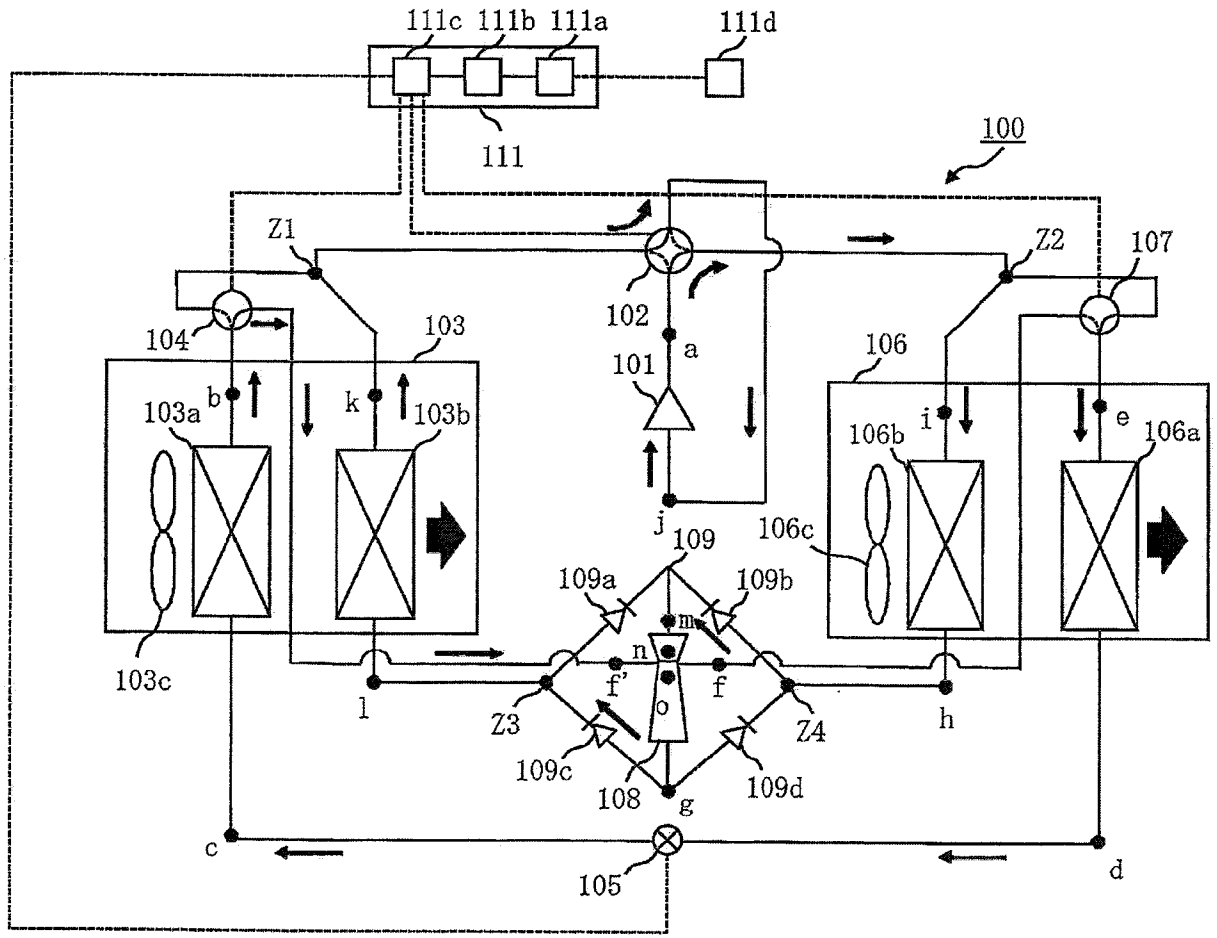
FIG. 5 is a schematic diagram illustrating the configuration of the refrigeration cycle device according to Embodiment 1 (in a cooling operation).
Figure 6:
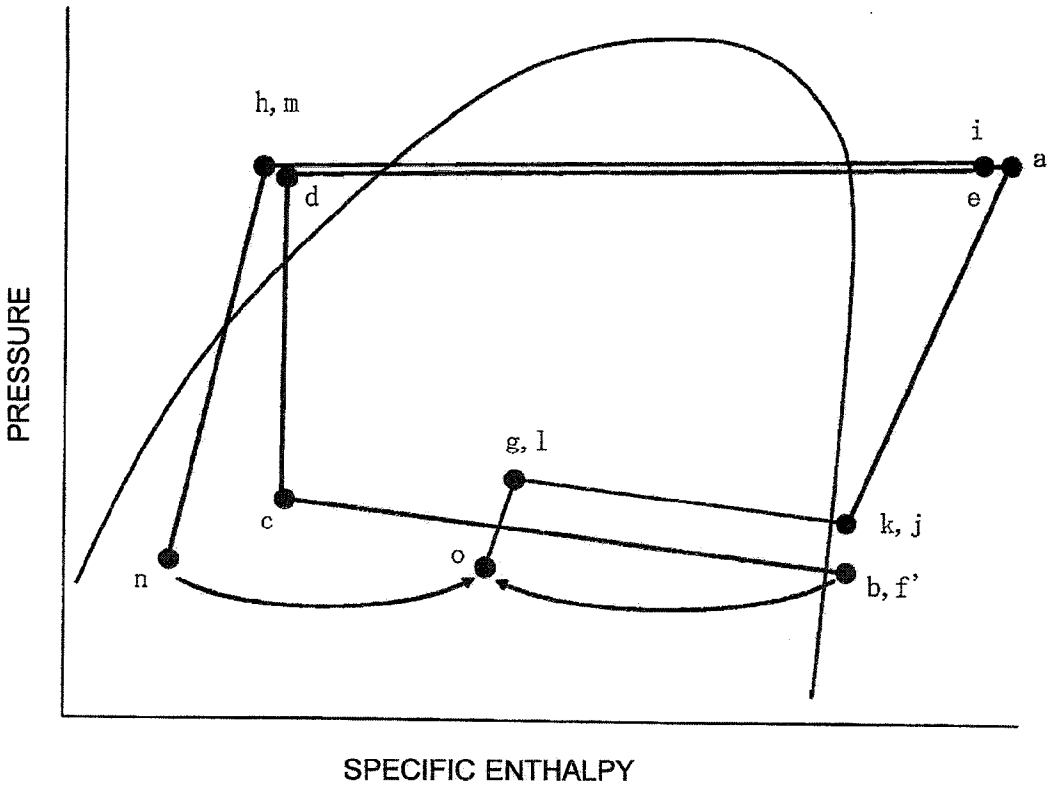
FIG. 6 is a refrigeration cycle diagram (a Mollier diagram) illustrating states of a refrigerant in the refrigeration cycle device according to Embodiment 1 in a cooling operation.

FIG. 5 is a schematic diagram illustrating the configuration of the refrigeration cycle device 100 (in a cooling operation). FIG. 6 is a refrigeration cycle diagram (a Mollier diagram) illustrating states of a refrigerant in the refrigeration cycle device 100 in a cooling operation. Points a to o in the diagram of FIG. 6 represent states of a refrigerant in each of the pipes illustrated in FIG. 5.

In FIG. 5 and FIG. 6, a high temperature, high pressure gas refrigerant that has been sent out from the compressor 101 and is in a state a passes through the four-way valve 102 and splits so as to flow into the first outdoor heat exchanger 106*a* and the second outdoor heat exchanger 106*b* at a branch point Z2. The refrigerant that splits and flows in the first outdoor heat exchanger 106*a* passes through the second switching valve 107 and is condensed in a first outdoor heat exchanger 10*ba* through heat exchange between the refrigerant and the outside air. Then, the refrigerant changes from a state e to a state d. A liquid or two-phase gas-liquid refrigerant in the state d enters to a state c by being decompressed in the flow rate control valve 105, and after that, flows into the first indoor heat exchanger 103*a*. In the first indoor heat exchanger 103*a*, the refrigerant is evaporated through heat exchange between the refrigerant and the indoor air and changes from the state c to a state b. The refrigerant that is in the state b and in the gas phase passes through the first switching valve 104 and flows into the refrigerant suction port 205 of the ejector 108.

On the other hand, the refrigerant that flows in the second outdoor heat exchanger 106*b* from the branch point Z2 is condensed by the air, which has undergone heat exchange in the first outdoor heat exchanger 106*a*, and changes from a state i to a state h. The refrigerant in the state h flows into the refrigerant inlet port 204 of the ejector 108 from a branch point Z4 by passing through the check valve 109*b*. The refrigerant in a state m that flows in the refrigerant inlet port 204 changes to a state n by being decompressed in the nozzle unit 201, and after that, is mixed with a refrigerant in a state f that has flowed from the refrigerant suction port 205 in such a manner as to enter a state o. The pressure of the refrigerant in the state o increases in the mixing portion 202 and the diffuser portion 203, and after that, the refrigerant enters a state g and flows out from the refrigerant outlet port 206. The refrigerant in the state g flows into the second indoor heat exchanger 103*b* by passing through the check valve 109*c*. The refrigerant in the state l that flows in the second indoor heat exchanger 103*b* is evaporated through heat exchange between the refrigerant and the indoor air and enters a state k and flows into the four-way valve 102 and the suction port of the compressor 101.

In a cooling operation, as a result of the operation of the valve 109*e* such as that described above, the check valves 109*b* and 109*c* are in the open state, and the check valves 109*a* and 109*d* are in the closed state. Therefore, a refrigerant flows into the ejector 108 via the check valve 109*b* and flows into the second indoor heat exchanger 103*b* via the check valve 109*c*.

As described above, in Embodiment 1, the refrigeration cycle device 100 that performs a heating operation and a cooling operation by switching back and forth between these operations includes the compressor 101, a first heat exchanger (e.g., the first indoor heat exchanger 103*a*), a second heat exchanger (e.g., the first outdoor heat exchanger 106*a*), a third heat exchanger (e.g., the second indoor heat exchanger 103*b*), a fourth heat exchanger (e.g., the second outdoor heat exchanger 106*b*), the ejector 108, a controller (e.g., the flow rate control valve 105), a switching device (that is formed of, for example, the flow path switching device 109, the first switching valve 104, the second switching valve 107, and the four-way valve 102), and the control unit 111.

The compressor 101 suctions a refrigerant and compresses the refrigerant. The first heat exchanger, the second heat exchanger, the third heat exchanger, and the fourth heat exchanger perform heat exchange on a refrigerant. The ejector 108 includes the refrigerant inlet port 204, the refrigerant suction port 205, and the refrigerant outlet port 206. The ejector 108 decompresses a refrigerant that flows into the refrigerant inlet port 204, pressurizes the refrigerant by mixing the refrigerant, which has been decompressed, and a refrigerant that is suctioned by the refrigerant suction port 205 together, and discharges the refrigerant, which has been pressurized, from the refrigerant outlet port 206. The controller is connected between the first heat exchanger and the second heat exchanger and controls the flow rate of a refrigerant. In a heating operation, the switching device performs switching of a flow path of a refrigerant in such a manner that a refrigerant that has been compressed by the compressor 101 flows into the refrigerant inlet port 204 of the ejector 108 via the third heat exchanger and is drawn by the refrigerant suction port 205 of the ejector 108 via the first heat exchanger, the controller, and the second heat exchanger in this order, and in such a manner that a refrigerant that is discharged from the refrigerant outlet port 206 of the ejector 108 is suctioned by the compressor 101 via the fourth heat exchanger. In a cooling operation, the switching device performs switching of a flow path of a refrigerant in such a manner that a refrigerant that has been compressed by the compressor 101 flows into the refrigerant inlet port 204 of the ejector 108 via the fourth heat exchanger and is drawn by the refrigerant suction port 205 of the ejector 108 via the second heat exchanger, the controller, and the first heat exchanger in this order, and in such a manner that a refrigerant that is discharged from the refrigerant outlet port 206 of the ejector 108 is suctioned by the compressor 101 via the third heat exchanger.

The switching device includes, for example, the flow path switching device 109 that is formed of a first check valve (e.g., the check valve 109*a*), a second check valve (e.g., the check valve 109*b*), a third check valve (e.g., the check valve 109*c*), and a fourth check valve (e.g., the check valve 109*d*).

The first check valve is connected between the third heat exchanger and the refrigerant inlet port 204 of the ejector 108. The second check valve is connected between the fourth heat exchanger and the refrigerant inlet port 204 of the ejector 108. The third check valve is connected between the refrigerant outlet port 206 of the ejector 108 and the third heat exchanger. The third check valve is closed during a heating operation and is open during a cooling operation. The fourth check valve is connected between the refrigerant outlet port 206 of the ejector 108 and the fourth heat exchanger. The fourth check valve is open during a heating operation and is closed during a cooling operation.

The switching device includes, for example, the first switching valve 104 and the second switching valve 107.

The first switching valve 104 is connected among the compressor 101, the first heat exchanger, and the refrigerant suction port 205 of the ejector 108. The second switching valve 107 is connected among the compressor 101, the second heat exchanger, and the refrigerant suction port 205 of the ejector 108. In a heating operation, the control unit 111 opens a flow path between the compressor 101 and the first heat exchanger at the first switching valve 104 and opens a flow path between the second heat exchanger and the refrigerant suction port 205 of the ejector 108 at the second switching valve 107. In a cooling operation, the control unit 111 opens a flow path between the first heat exchanger and the refrigerant suction port 205 of the ejector 108 at the first switching valve 104 and opens a flow path between the compressor 101 and the second heat exchanger at the second switching valve 107.

The switching device further includes, for example, the four-way valve 102.

The four-way valve 102 is connected among an outlet port of the compressor 101, a first connection point (e.g., the branch point Z1) at which the first switching valve 104 and the third heat exchanger are connected to each other, a second connection point (e.g., the branch point Z2) at which the second switching valve 107 and the fourth heat exchanger are connected to each other, and an inlet port of the compressor 101. In a heating operation, the control unit 111 opens a flow path between the outlet port of the compressor 101 and the first connection point and a flow path between the second connection point and the inlet port of the compressor 101 at the four-way valve 102. In a cooling operation, the control unit 111 opens a flow path between the outlet port of the compressor 101 and the second connection point and a flow path between the first connection point and the inlet port of the compressor 101 at the four-way valve 102.

The configuration of the switching device is not limited to the above, and suitable modifications may be made.

Advantageous effects of Embodiment 1 will be described.

Figure 7:
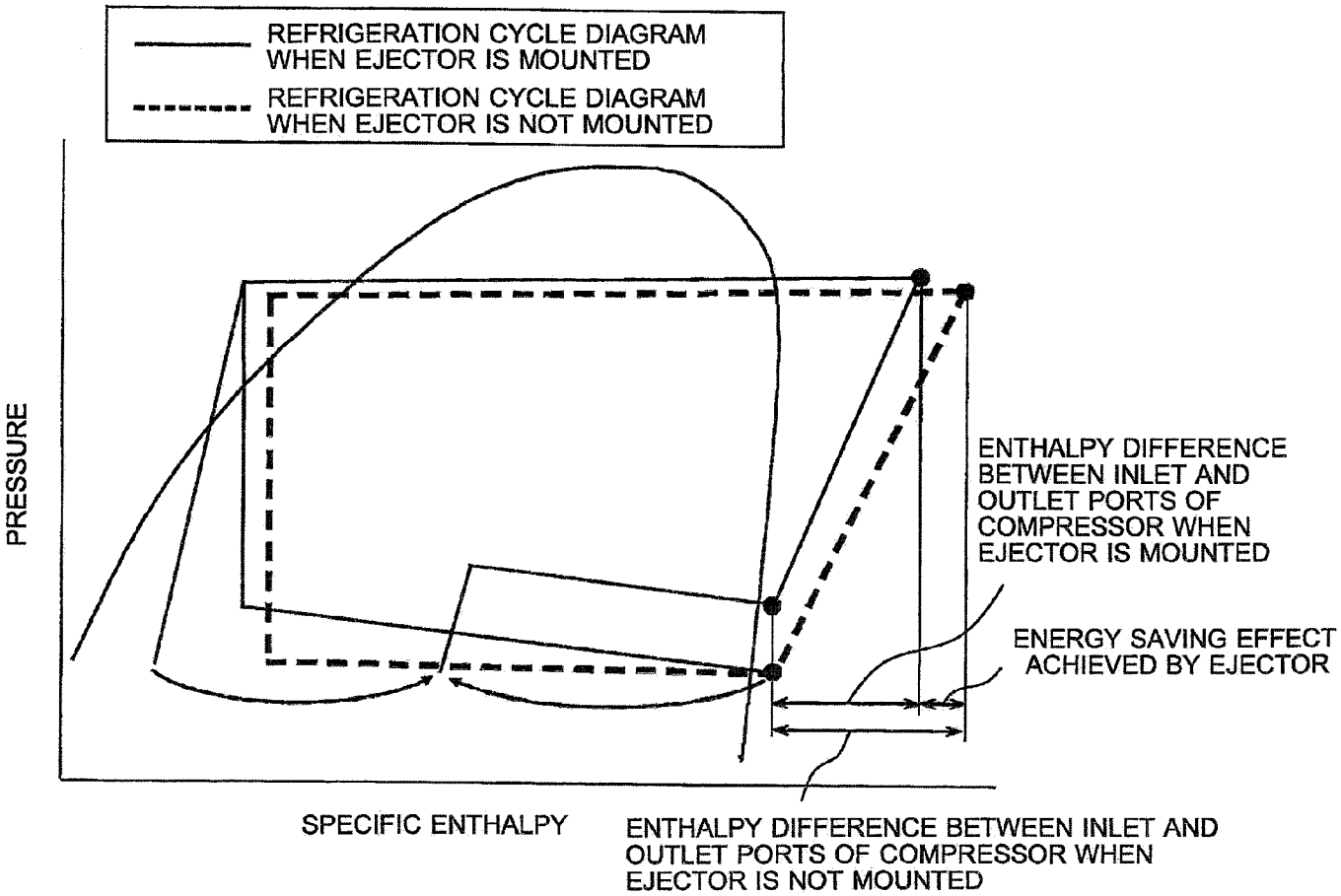
FIG. 7 is a refrigeration cycle diagram that compares states of a refrigerant in the refrigeration cycle device according to Embodiment 1 (in the case where the ejector is mounted) and states of a refrigerant in a refrigeration cycle device in which an ejector is not mounted (in the case where the ejector is not mounted).

FIG. 7 is a refrigeration cycle diagram that compares states of a refrigerant in the refrigeration cycle device 100 according to Embodiment 1 (in the case where the ejector 108 is mounted) and states of a refrigerant in a refrigeration cycle device in which an ejector is not mounted (in the case where the ejector 108 is not mounted).

In FIG. 7, a power consumption $Q_{comp}$ of the compressor 101 can be expressed by $Q_{comp}=W\ (h_{comp,\ out}-h_{comp,\ in})$ where a suction enthalpy of the compressor 101 is $h_{comp,\ in}$, a discharge enthalpy of the compressor 101 is $_{hcomp,\ out}$, and a flow rate is W. In the case where the ejector 108 is mounted in the compressor 101, a suction pressure of the compressor 101 increases as compared with the case where the ejector 108 is not mounted in the compressor 101, and the discharge enthalpy $h_{comp,\ out}$ of the compressor 101 is reduced. Therefore, the enthalpy difference $(h_{comp,\ out}-h_{comp,\ in})$ between the inlet and outlet ports of the compressor 101 is reduced. As a result, the power consumption of the compressor 101 is reduced.

In Embodiment 1, the refrigeration cycle device 100 includes the flow path switching device 109 that causes a high-pressure refrigerant to flow into the refrigerant inlet port 204 of the ejector 108. As a result, a power recovery operation by the ejector 108 can be performed in both cooling and heating operation modes, and a highly-efficient operation of a refrigeration cycle can be realized in both the modes.

According to Embodiment 1, it is not necessary to connect a gas-liquid separator to the refrigerant outlet port 206 of the ejector 108. Therefore, a reduction in the amount of lubricating oil in the compressor can be suppressed.

In Embodiment 1, in a heating operation, heat exchange between the indoor air sent out from the air-sending fan 103*c* and a refrigerant in the state b is performed in the first indoor heat exchanger 103*a*, and after that, heat exchange between the air and a refrigerant in the state k is further performed in the second indoor heat exchanger 103*b*. Therefore, the indoor air can be efficiently heated. In a cooling operation, heat exchange between the indoor air sent out from the air-sending fan 103*c* and a refrigerant in the state c is performed in the first indoor heat exchanger 103*a*, and after that, heat exchange between the air and a refrigerant in the state l is further performed in the second indoor heat exchanger 103*b*. Therefore, the indoor air can be efficiently cooled. In other words, in Embodiment 1, the indoor heat exchanger 103 can be made to have two types of temperature differences by dividing the indoor heat exchanger 103, and efficient heat exchange can be performed by utilizing these temperature differences. Therefore, the ability of the indoor heat exchanger 103 is improved, and the COP (coefficient of performance) of the refrigeration cycle device 100 increases.

Similarly, in Embodiment 1, in a heating operation, heat exchange between the outside air sent out from the air-sending fan 106*c* and a refrigerant in the state h is performed in the second outdoor heat exchanger 106*b*, and after that, heat exchange between the air and a refrigerant in the state d is further performed in the first outdoor heat exchanger 106*a*. In a cooling operation, heat exchange between the outside air sent out from the air-sending fan 106*c* and a refrigerant in the state i is performed in the second outdoor heat exchanger 106*b*, and after that, heat exchange between the air and a refrigerant in the state e is further performed in the first outdoor heat exchanger 106*a*. In other words, in Embodiment 1, the outdoor heat exchanger 106 can be made to have two types of temperature differences by dividing the outdoor heat exchanger 106, and efficient heat exchange can be performed by utilizing these temperature differences. Therefore, the ability of the outdoor heat exchanger 106 is improved, and the COP of the refrigeration cycle device 100 increases.

A refrigerant that is used in the refrigeration cycle device 100 according to Embodiment 1 is not limited to a fluorocarbon refrigerant such as R410A or R32 or a fluorocarbon mixed refrigerant, and a hydrocarbon refrigerant such as propane or isobutene or a natural refrigerant such as carbon dioxide or ammonia may be used. In Embodiment 1, the above-described advantageous effects can be obtained by using any one of the above refrigerants.

In the case where propane is used as a refrigerant, since propane is a flammable refrigerant, it is desirable that a water-refrigerant heat exchanger such as a plate heat exchanger be employed as the indoor heat exchanger 103, and it is desirable that the outdoor heat exchanger 106 be accommodated in a casing in which the indoor heat exchanger 103 is accommodated and installed as an integral structure at a location spaced apart from an indoor space. Then, cold water or warm water generated by the water-refrigerant heat exchanger is made to circulate. As a result, the refrigeration cycle device 100 having a high level of safety can be provided.

The refrigeration cycle device 100 according to Embodiment 1 can be used by being mounted in an air-conditioning apparatus and also can be used by being mounted in a chiller, a brine cooler, or the like.

Embodiment 2.

Embodiment 2 will be described mainly focusing on differences between Embodiment 1 and Embodiment 2.

Figure 8:
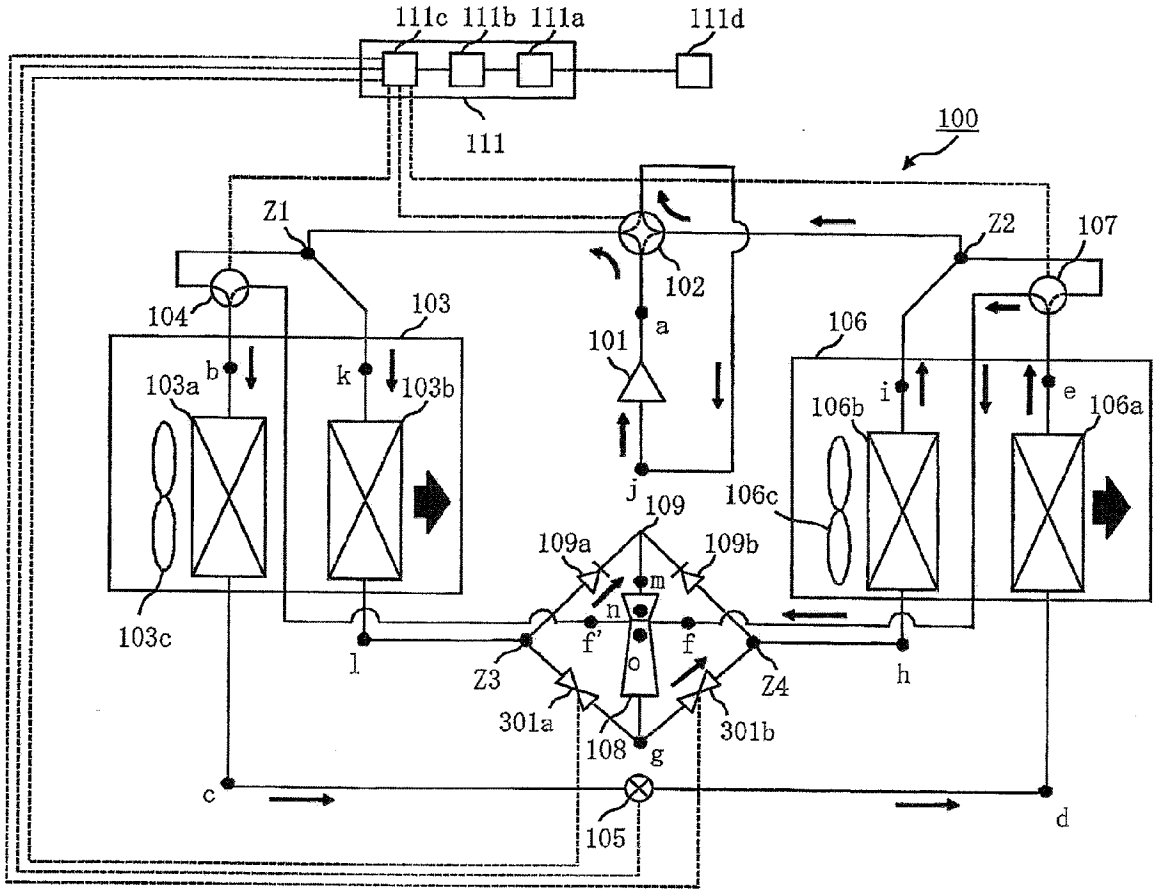
FIG. 8 is a schematic diagram illustrating the configuration of a refrigeration cycle device according to Embodiment 2 (in a heating operation).

FIG. 8 is a schematic diagram illustrating the configuration of the refrigeration cycle device 100 according to Embodiment 2 (in a heating operation).

The configuration of the refrigeration cycle device 100 will be described.

As illustrated in FIG. 8, in Embodiment 2, the flow path switching device 109 is formed of the check valves 109*a* and 109*b* and electromagnetic on-off valves 301*a* and 301*b*. In other words, the refrigeration cycle device 100 includes the electromagnetic on-off valves 301*a* and 301*b* in place of the check valves 109*c*, and 109*d* of Embodiment 1. The rest of the configuration of the refrigeration cycle device 100 is the same as that of Embodiment 1.

The electromagnetic on-off valves 301*a* and 301*b* are connected to the sending unit 111*c*, which is included in the control unit 111, by electric signal lines and perform opening and closing operations in accordance with instructions from the control unit 111. In the case of a heating operation, an instruction from the control unit 111 causes the electromagnetic on-off valves 301*a* and 301*b* to be in a closed state and in an open state, respectively. On the other hand, in the case of a cooling operation, an instruction from the control unit 111 makes the electromagnetic on-off valves 301*a* and 301*b* to be in an open state and in a closed state, respectively.

Operation of the refrigeration cycle device 100 in a heating operation will be described.

States of a refrigerant in the refrigeration cycle device 100 in a heating operation are similar to those of Embodiment 1 illustrated in FIG. 3.

In FIG. 8 and FIG. 3, a high temperature, high pressure gas refrigerant that has been sent out from the compressor 101 and is in a state a passes through the four-way valve 102 and splits so as to flow into the first indoor heat exchanger 103*a* and the second indoor heat exchanger 103*b* at a branch point Z1. The refrigerant that splits and flows in the first indoor heat exchanger 103*a* passes through the first switching valve 104 and is condensed in the first indoor heat exchanger 103*a* through heat exchange between the refrigerant and the indoor air. Then, the refrigerant changes from a state b to a state c. A liquid or two-phase gas-liquid refrigerant in the state c enters to a state d by being decompressed in the flow rate control valve 105, and after that, flows into the first outdoor heat exchanger 106*a*. In the first outdoor heat exchanger 106*a*, the refrigerant is evaporated through heat exchange between the refrigerant and the outside air and changes from the state d to a state e. The refrigerant that is in the state e and in the gas phase passes through the second switching valve 107 and flows into the refrigerant suction port 205 of the ejector 108.

On the other hand, the refrigerant that flows in the second indoor heat exchanger 103*b* from the branch point Z1 is condensed by the air, which has undergone heat exchange in the first indoor heat exchanger 103*a*, and changes from a state k to a state l. The refrigerant in the state l flows into the refrigerant inlet port 204 of the ejector 108 from a branch point Z3 by passing through the check valve 109*a*. The refrigerant in a state m that flows in the refrigerant inlet port 204 changes to a state n by being decompressed in the nozzle unit 201, and after that, is mixed with a refrigerant in a state f that has flowed from the refrigerant suction port 205 in such a manner as to enter a state o. The pressure of the refrigerant in the state o increases in the mixing portion 202 and the diffuser portion 203, and after that, the refrigerant enters a state g and flows out from the refrigerant outlet port 206. The refrigerant in the state g flows into the second outdoor heat exchanger 106*b* by passing through the electromagnetic on-off valve 301*b*. The refrigerant in a state h that flows in the second outdoor heat exchanger 106*b* is evaporated through heat exchange between the refrigerant and the outside air and enters a state l and flows into the four-way valve 102 and a suction port of the compressor 101.

In a cooling operation, the electromagnetic on-off valves 301*a* and 301*b* perform opening and closing operations that are opposite to the opening and closing operations performed by the electromagnetic on-off valves 301*a* and 301*b* in the heating operation, so that the refrigerant that has flowed out from the ejector 108 flows into the second indoor heat exchanger 103*b*.

As described above, in Embodiment 2, the flow path switching device 109 is formed of a first check valve (e.g., the check valve 109*a*), a second check valve (e.g., the check valve 109*b*), a first on-off valve (e.g., the electromagnetic on-off valve 301*a*) and a second on-off valve (e.g., the electromagnetic on-off valve 301*b*).

The first on-off valve is connected between the refrigerant outlet port 206 of the ejector 108 and the third heat exchanger. The second on-off valve is connected between the refrigerant outlet port 206 of the ejector 108 and the fourth heat exchanger. In a heating operation, the control unit 111 closes the first on-off valve and opens the second on-off valve. In a cooling operation, the control unit 111 opens the first on-off valve and closes the second on-off valve.

Advantageous effects of Embodiment 2 will be described.

In Embodiment 2, the electromagnetic on-off valves 301 a and 301 b each having a smaller flow path resistance than a check valve are used as a part of the flow path switching device 109, so that a refrigerant can be drawn into the compressor 101 at a higher pressure. Although a mounting direction of a check valve is limited due to the configuration of the check valve (see FIG. 4), a mounting direction of the on-off valves of Embodiment 2 is not limited, and thus, a refrigerant pipe can be made short.

In Embodiment 2, the electromagnetic on-off valves 301*a* and 301*b* are used as only a part of the flow path switching device 109. However, the entirety of the flow path switching device 109 may be formed of on-off valves. In other words, on-off valves may be used in place of the check valves 109*a* and 109*b*.

Embodiment 3.

Embodiment 3 will be described mainly focusing on differences between Embodiment 1 and Embodiment 3.

Figure 9:
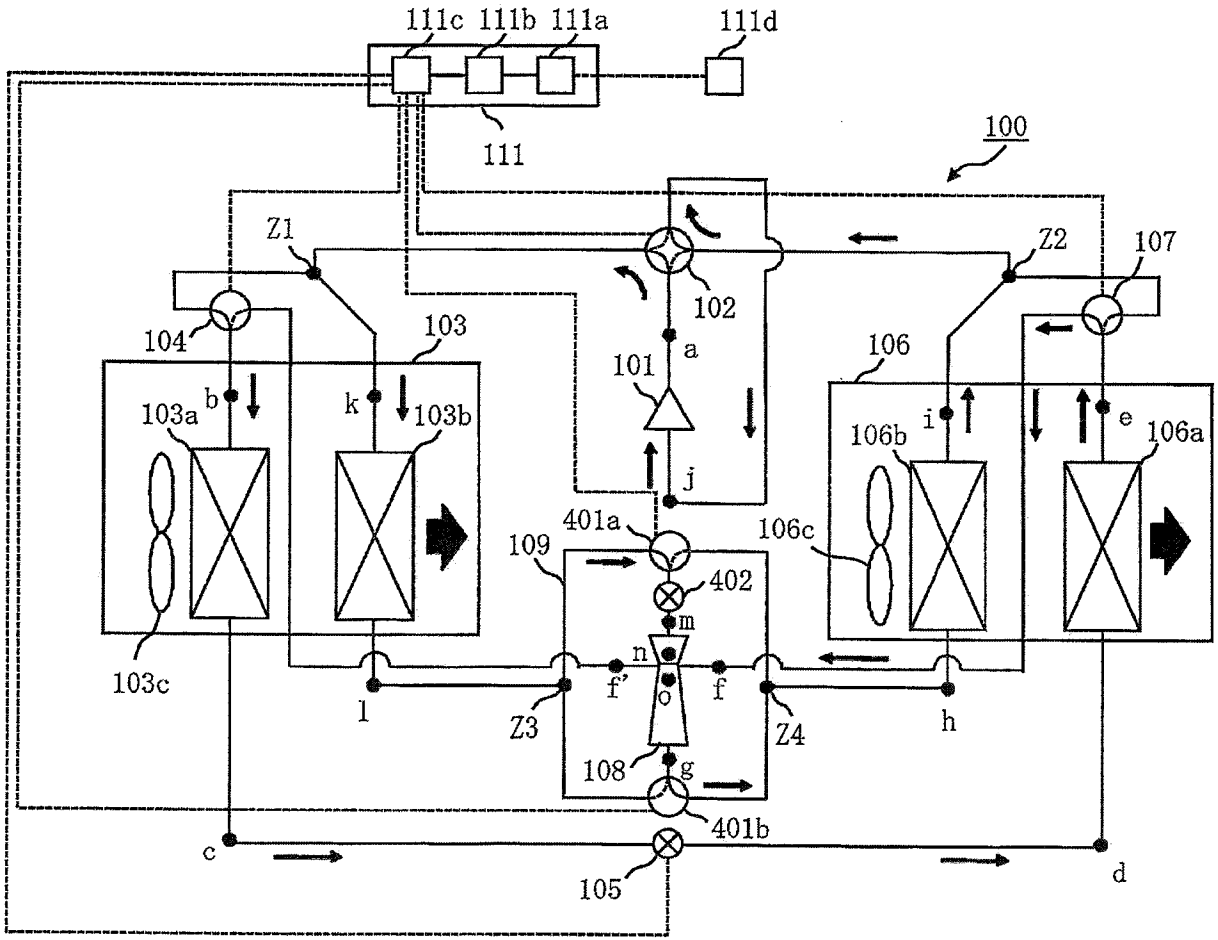
FIG. 9 is a schematic diagram illustrating the configuration of a refrigeration cycle device according to Embodiment 3 (in a heating operation).

FIG. 9 is a schematic diagram illustrating the configuration of the refrigeration cycle device 100 according to Embodiment 3 (in a heating operation).

The configuration of the refrigeration cycle device 100 will be described.

As illustrated in FIG. 9, in Embodiment 3, the flow path switching device 109 is formed of three-way valves 401*a* and 401*b*. In other words, the refrigeration cycle device 100 includes the three-way valves 401*a* and 401*b* in place of the check valves 109*a*, 109*b*, 109*c*, and 109*d* of Embodiment 1. The refrigeration cycle device 100 further includes a flow rate control valve 402. The rest of the configuration of the refrigeration cycle device 100 is the same as that of Embodiment 1. The flow rate control valve 402 and the three-way valve 401*a* are connected to the refrigerant inlet port 204 of the ejector 108 in this order. The three-way valve 401*b* is connected to the refrigerant outlet port 206 of the ejector 108.

The three-way valves 401*a* and 401*b* are connected to the sending unit 111*c*, which is included in the control unit 111, by electric signal lines and perform an operation of switching flow paths in accordance with an instruction from the control unit 111. In the case of a heating operation, in response to an instruction from the control unit 111, the three-way valve 401*a* switches to a flow path between the second indoor heat exchanger 103*b* and the ejector 108, and the three-way valve 401*b* switches to a flow path between the ejector 108 and the second outdoor heat exchanger 106*b*. On the other hand, in the case of a cooling operation, in response to an instruction from the control unit 111, the three-way valve 401*a* switches to a flow path between the second outdoor heat exchanger 106*b* and the ejector 108, and the three-way valve 401*b* switches to a flow path between the ejector 108 and the second indoor heat exchanger 103*b*.

Although not illustrated, the flow rate control valve 402 is also connected to the sending unit 111*c*, which is included in the control unit 111, by an electric signal line and controls the flow rate of a refrigerant that flows into the ejector 108 in accordance with an instruction from the control unit 111. In the case where the amount of a refrigerant that is to be sent out is adjusted by controlling the frequency of the compressor 101 by using an inverter, that is, in the case where the amount of a refrigerant that circulates in a refrigeration cycle is changed, the distribution ratio of the refrigerant at the branch point Z1 is controlled to an appropriate amount by using the flow rate control valve 105 and the flow rate control valve 402 in a heating operation, and the distribution ratio of the refrigerant at the branch point Z2 is controlled to an appropriate amount by using the flow rate control valve 105 and the flow rate control valve 402 in a cooling operation.

Operation of the refrigeration cycle device 100 in a heating operation will be described.

States of a refrigerant in the refrigeration cycle device 100 in a heating operation are similar to those of Embodiment 1 illustrated in FIG. 3.

In FIG. 9 and FIG. 3, a high temperature, high pressure gas refrigerant that has been sent out from the compressor 101 and is in a state a passes through the four-way valve 102 and splits so as to flow into the first indoor heat exchanger 103*a* and the second indoor heat exchanger 103*b* at a branch point Z1. The refrigerant that splits and flows in the first indoor heat exchanger 103*a* passes through the first switching valve 104 and is condensed in the first indoor heat exchanger 103*a* through heat exchange between the refrigerant and the indoor air. Then, the refrigerant changes from a state b to a state c. A liquid or two-phase gas-liquid refrigerant in the state c enters to a state d by being decompressed in the flow rate control valve 105, and after that, flows into the first outdoor heat exchanger 106*a*. In the first outdoor heat exchanger 106*a*, the refrigerant is evaporated through heat exchange between the refrigerant and the outside air and changes from the state d to a state e. The refrigerant that is in the state e and in the gas phase passes through the second switching valve 107 and flows into the refrigerant suction port 205 of the ejector 108.

On the other hand, the refrigerant that flows in the second indoor heat exchanger 103*b* from the branch point Z1 is condensed by the air, which has undergone heat exchange in the first indoor heat exchanger 103*a*, and changes from a state k to a state l. The refrigerant in the state l flows into the refrigerant inlet port 204 of the ejector 108 from a branch point Z3 by passing through the three-way valve 401*a*. The refrigerant in a state m that flows in the refrigerant inlet port 204 changes to a state n by being decompressed in the nozzle unit 201, and after that, is mixed with a refrigerant in a state f that has flowed from the refrigerant suction port 205 in such a manner as to enter a state o. The pressure of the refrigerant in the state o increases in the mixing portion 202 and the diffuser portion 203, and after that, the refrigerant enters a state g and flows out from the refrigerant outlet port 206. The refrigerant in the state g flows into the second outdoor heat exchanger 106*b* by passing through the three-way valve 401*b*. The refrigerant in a state h that flows in the second outdoor heat exchanger 106*b* is evaporated through heat exchange between the refrigerant and the outside air and enters a state l and flows into the four-way valve 102 and a suction port of the compressor 101.

In a cooling operation, the three-way valves 401*a* and 401*b* perform an operation of switching flow paths that is opposite to the operation of switching flow paths performed by the three-way valves 401*a* and 401*b* in the heating operation, so that the refrigerant flowed out from the ejector 108 flows into the second indoor heat exchanger 103*b*.

As described above, in Embodiment 3, the flow path switching device 109 is formed of a first three-way valve (e.g., the three-way valve 401*a*) and a second three-way valve (e.g., the three-way valve 401*b*).

The first three-way valve is connected among the third heat exchanger, the fourth heat exchanger, and the refrigerant inlet port 204 of the ejector 108. The second three-way valve is connected among the refrigerant outlet port 206 of the ejector 108, the third heat exchanger, and the fourth heat exchanger. In a heating operation, the control unit 111 opens a flow path between the third heat exchanger and the refrigerant inlet port 204 of the ejector 108 at the first three-way valve and opens a flow path between the refrigerant outlet port 206 of the ejector 108 and the fourth heat exchanger at the second three-way valve. In a cooling operation, the control unit 111 opens a flow path between the fourth heat exchanger and the refrigerant inlet port 204 of the ejector 108 at the first three-way valve and opens a flow path between the refrigerant outlet port 206 of the ejector 108 and the third heat exchanger at the second three-way valve.

In Embodiment 4, the refrigeration cycle device 100 further includes a control valve (e.g., the flow rate control valve 402) that controls the amount of a refrigerant that flows into the refrigerant inlet port 204 of the ejector 108.

Advantageous effects of Embodiment 3 will be described.

In Embodiment 3, the number of element components that form a refrigerant circuit can be reduced, and as a result, a casing of the refrigeration cycle device 100 can be reduced in size.

Embodiment 4.

Embodiment 4 will be described mainly focusing on differences between Embodiment 3 and Embodiment 4.

Figure 10:
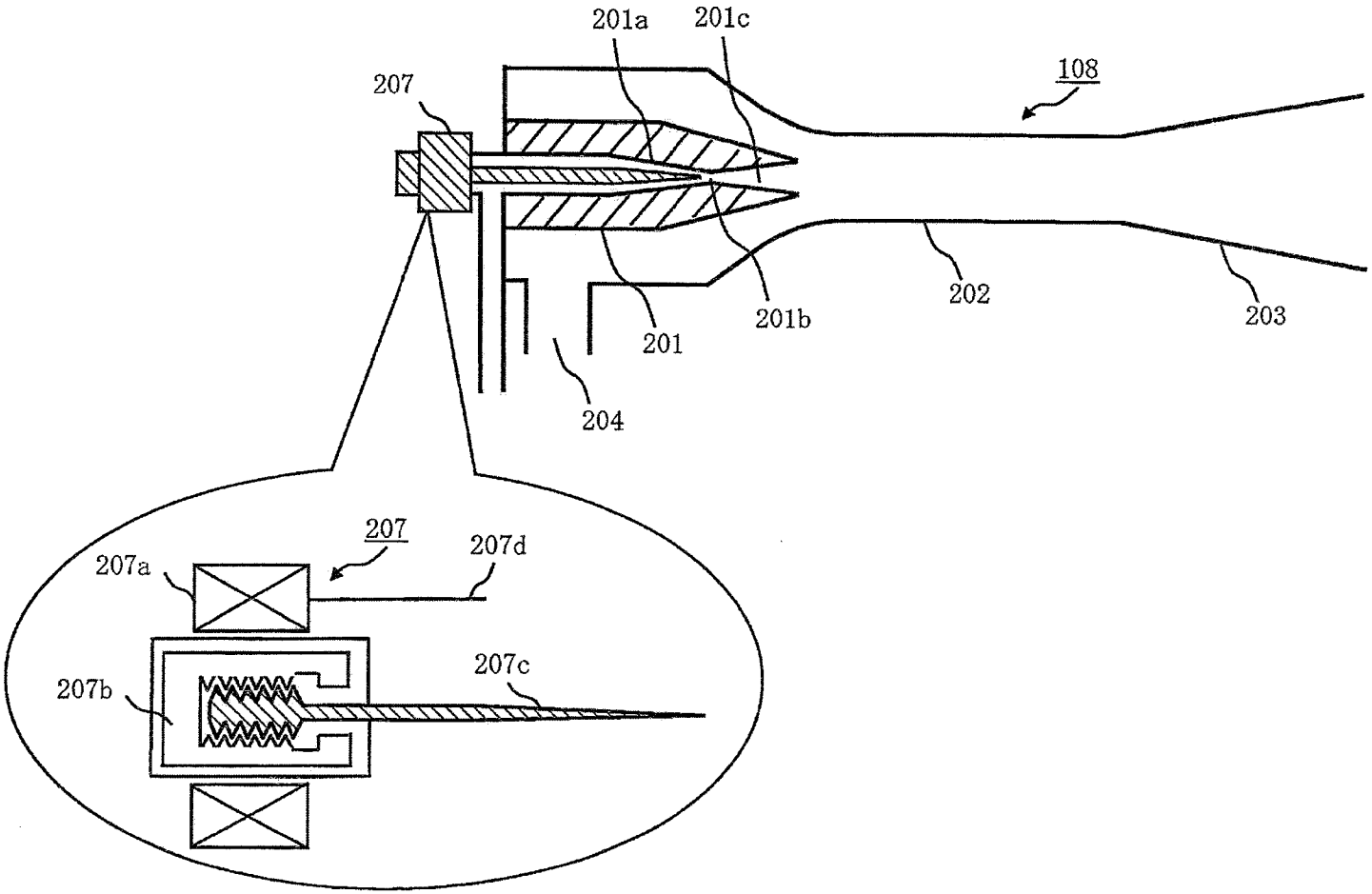
FIG. 10 is a schematic diagram illustrating the internal structure of an ejector that has a variable expansion mechanism and that is provided in a refrigeration cycle device according to Embodiment 4.

FIG. 10 is a schematic diagram illustrating the internal structure of the ejector 108 having a variable expansion mechanism that is provided in the refrigeration cycle device 100 according to Embodiment 4.

Although the flow rate control valve 402 is connected on an upstream side of the ejector 108 in Embodiment 3, the ejector 108 with which a movable needle valve 207 that has a function equivalent to that of the flow rate control valve 402 is integrated may be used as illustrated in FIG. 10.

The needle valve 207 is formed of a coil unit 207*a*, a rotor unit 207*b*, and a needle unit 207*c*. The coil unit 207*a* is connected to the receiving unit 111*c* of the control unit 111 by a cable 207*d* (i.e., an electric signal line). When the coil unit 207*a* receives a pulse signal via the cable 207*d*, a magnetic pole is generated, and the rotor unit 207*b* that is surrounded by the coil unit 207*a* rotates. The inner side of a rotation axis of the rotor unit 207*b* is threaded, and the needle unit 207*c* is screwed in the rotor unit 207*b*. When the rotor unit 207*b* rotates, the needle unit 207*c* moves in an axial direction (the left-right direction in FIG. 10). The amount of a motive refrigerant that flows into the nozzle unit 201 is adjusted in accordance with the movement of the needle unit 207*c*.

In Embodiment 4, the flow rate control valve 402 of Embodiment 3 is integrated with the ejector 108 as the movable needle valve 207. In other words, in Embodiment 4, a control valve that controls the amount of a refrigerant that flows into the refrigerant inlet port 204 of the ejector 108 is integrally arranged with the ejector 108. Therefore, a pipe that connects the control valve and the ejector 108 is not necessary. As a result, the configuration becomes simpler, and cost reduction can be achieved.

Although the embodiments of the present invention have been described above, two or more embodiments among these embodiments may be combined and implemented. Alternatively, one of these embodiments may be partially implemented. Alternatively, two or more embodiments among these embodiments may be partially combined and implemented. Note that the present invention is not limited to these embodiments, and various modifications can be made as may be necessary.

REFERENCE SIGNS LIST

100 refrigeration cycle device 101 compressor 102 four-way valve 103 indoor heat exchanger 103*a* first indoor heat exchanger 103*b* second indoor heat exchanger 103*c* air-sending fan 104 first switching valve 105 flow rate control valve 106 outdoor heat exchanger 106*a* first outdoor heat exchanger 106*b* second outdoor heat exchanger 106*c* air-sending fan 107 second switching valve 108 ejector 109 flow path switching device 109*a*, 109*b*, 109*c*, 109*d* check valve 109*e* valve 111 control unit 111*a* receiving unit 111*b* operation unit 111*c* sending unit 111*d* command device 201 nozzle unit 201*a* expansion portion 201*b* throat portion 201*c* diverging portion 202 mixing portion 203 diffuser portion 204 refrigerant inlet port 205 refrigerant suction port 206 refrigerant outlet port 207 needle valve 207*a* coil unit 207*b* rotor unit 207*c* needle unit 207*d* cable 301*a*, 301*b* electromagnetic on-off valve 401*a*, 401*b* three-way valve 402 flow rate control valve

The invention claimed is:

1. A refrigeration cycle device that performs a heating operation and a cooling operation selectively, the refrigeration cycle device comprising:

a compressor that suctions a refrigerant and compresses the refrigerant;

a first heat exchanger, a second heat exchanger, a third heat exchanger, and a fourth heat exchanger each of which exchanges heat with the refrigerant;

an ejector that includes a refrigerant inlet port, a refrigerant suction port, and a refrigerant outlet port, and that is configured to decompress the refrigerant that flows into the refrigerant inlet port, pressurize the refrigerant by mixing the refrigerant that has been decompressed, and the refrigerant that is suctioned by the refrigerant suction port together, and discharge the refrigerant that has been pressurized, from the refrigerant outlet port;

a first control valve that is connected between the first heat exchanger and the second heat exchanger and configured to control a flow rate of the refrigerant; and a switching device configured to perform, in a heating operation, switching of a flow path of the refrigerant in such a manner that the refrigerant that is compressed by the compressor flows into the refrigerant inlet port of the ejector via the third heat exchanger and the refrigerant that is compressed by the compressor is suctioned by the refrigerant suction port of the ejector via the first heat exchanger, the first control valve, and the second heat exchanger in this order, and the refrigerant that is discharged from the refrigerant outlet port of the ejector is suctioned by the compressor via the fourth heat exchanger and the switching device being configured to perform, in a cooling operation, switching of a flow path of the refrigerant in such a manner that the refrigerant that is compressed by the compressor flows into the refrigerant inlet port of the ejector via the fourth heat exchanger and the refrigerant that is compressed by the compressor is suctioned by the refrigerant suction port of the ejector via the second heat exchanger, the first control valve, and the first heat exchanger in this order, and the refrigerant that is discharged from the refrigerant outlet port of the ejector is suctioned by the compressor via the third heat exchanger.

2. The refrigeration cycle device of claim 1, wherein the switching device includes a first check valve that is connected between the third heat exchanger and the refrigerant inlet port of the ejector and a second check valve that is connected between the fourth heat exchanger and the refrigerant inlet port of the ejector.

3. The refrigeration cycle device of claim 2, wherein the switching device further includes a third check valve that is connected between the refrigerant outlet port of the ejector and the third heat exchanger and that is closed during the heating operation and is open during the cooling operation and a fourth check valve that is connected between the refrigerant outlet port of the ejector and the fourth heat exchanger and that is open during the heating operation and is closed during the cooling operation.

4. The refrigeration cycle device of claim 2, wherein the switching device further includes a first on-off valve that is connected between the refrigerant outlet port of the ejector and the third heat exchanger and a second on-off valve that is connected between the refrigerant outlet port of the ejector and the fourth heat exchanger, and wherein the refrigeration cycle device further comprises a control unit that, in the heating operation, closes the first on-off valve and opens the second on-off valve and that, in the cooling operation, opens the first on-off valve and closes the second on-off valve.

5. The refrigeration cycle device of claim 2, wherein the switching device includes a first switching valve that is connected among the compressor, the first heat exchanger, and the refrigerant suction port of the ejector and a second switching valve that is connected among the compressor, the second heat exchanger, and the refrigerant suction port of the ejector, and wherein the refrigeration cycle device further comprises a control unit that, in the heating operation, opens a flow path between the compressor and the first heat exchanger at the first switching valve and opens a flow path between the second heat exchanger and the refrigerant suction port of the ejector at the second switching valve and that, in a cooling operation, opens a flow path between the first heat exchanger and the refrigerant suction port of the ejector at the first switching valve and opens a flow path between the compressor and the second heat exchanger at the second switching valve. second on-off valve.

6. The refrigeration cycle device of claim 5, wherein the switching device further includes a four-way valve that is connected among an outlet port of the compressor, a first connection point at which the first switching valve and the third heat exchanger are connected to each other, a second connection point at which the second switching valve and the fourth heat exchanger are connected to each other, and an inlet port of the compressor, and wherein the control unit opens a flow path between the outlet port of the compressor and the first connection point and a flow path between the second connection point and the inlet port of the compressor at the four-way valve in the heating operation and opens a flow path between the outlet port of the compressor and the second connection point and a flow path between the first connection point and the inlet port of the compressor at the four-way valve in the cooling operation.

7. The refrigeration cycle device of claim 1,
wherein the switching device includes
a first three-way valve that is connected among the third heat exchanger, the fourth heat exchanger, and the refrigerant inlet port of the ejector, and
wherein the refrigeration cycle device further comprises
a control unit that, in the heating operation, opens a flow path between the third heat exchanger and the refrigerant inlet port of the ejector at the first three-way valve and that, in the cooling operation, opens a flow path between the fourth heat exchanger and the refrigerant inlet port of the ejector at the first three-way valve.

8. The refrigeration cycle device of claim 7,
wherein the switching device further includes
a second three-way valve that is connected among the refrigerant outlet port of the ejector, the third heat exchanger, and the fourth heat exchanger, and
wherein the control unit opens a flow path between the refrigerant outlet port of the ejector and the fourth heat exchanger at the second three-way valve in the heating operation and opens a flow path between the refrigerant outlet port of the ejector and the third heat exchanger at the second three-way valve in the cooling operation.

9. The refrigeration cycle device of claim 1 further comprising:
a second control valve that controls an amount of the refrigerant that flows into the refrigerant inlet port of the ejector.

10. The refrigeration cycle device of claim 9,
wherein the second control valve is integrally arranged with the ejector.

11. The refrigeration cycle device of claim 1,
wherein the refrigerant is a fluorocarbon refrigerant or a fluorocarbon mixed refrigerant.

12. The refrigeration cycle device of claim 1,
wherein the refrigerant is a natural refrigerant.

13. An air-conditioning apparatus in which the refrigeration cycle device of claim 1 is mounted.

* * * * *